US005891001A

United States Patent [19]

Carnes et al.

[11] Patent Number: 5,891,001

[45] Date of Patent: Apr. 6, 1999

[54] SUSPENSION SYSTEM FOR TREADMILL WITH TRAMPOLINE-LIKE SURFACE

[75] Inventors: James P. Carnes, Coldspring; Edmund M. Mackert, Baytown, both of Tex.

[73] Assignee: Orbiter Royalty Trust, Baytown, Tex.

[21] Appl. No.: 22,901

[22] Filed: Feb. 12, 1998

[51] Int. Cl.[6] ..... A63B 22/02

[52] U.S. Cl. ..... 482/54

[58] Field of Search ..... 482/51, 54

[56] References Cited

U.S. PATENT DOCUMENTS

| | | | |
|---|---|---|---|
| 4,548,405 | 10/1985 | Lee et al. | 482/54 |
| 4,938,473 | 7/1990 | Lee et al. | 482/54 |
| 5,203,800 | 4/1993 | Meredith | 482/54 |
| 5,250,012 | 10/1993 | Meredith | 482/54 |
| 5,330,401 | 7/1994 | Walstead | 482/54 |

*Primary Examiner*—Lynne A. Reichard
*Attorney, Agent, or Firm*—Fulbright & Jaworski L.L.P.; Paul E. Kreiger, Esq.; Jan K. Simpson, Esq.

[57] ABSTRACT

A treadmill with a trampoline-like surface that includes an endless belt with generally parallel lateral edges and an upper surface forming a running surface and belt supports in close proximity to and extending along the lateral edges of the endless belt. The treadmill further includes a suspension system for suspending the endless belt from the supports as the belt moves in a longitudinal direction. The suspension system is comprised of a series of connectors along each lateral edge, each connector including at least one roller adapted to engage and move along the support, and a bracket connected between the roller and lateral edge of the endless belt. Each roller has an axis of rotation and the bracket is oriented to maintain the axis of rotation of each roller at an angle of between about 10–25 degrees toward the running surface relative to a plane perpendicular to the running surface.

3 Claims, 3 Drawing Sheets

FIG. 2
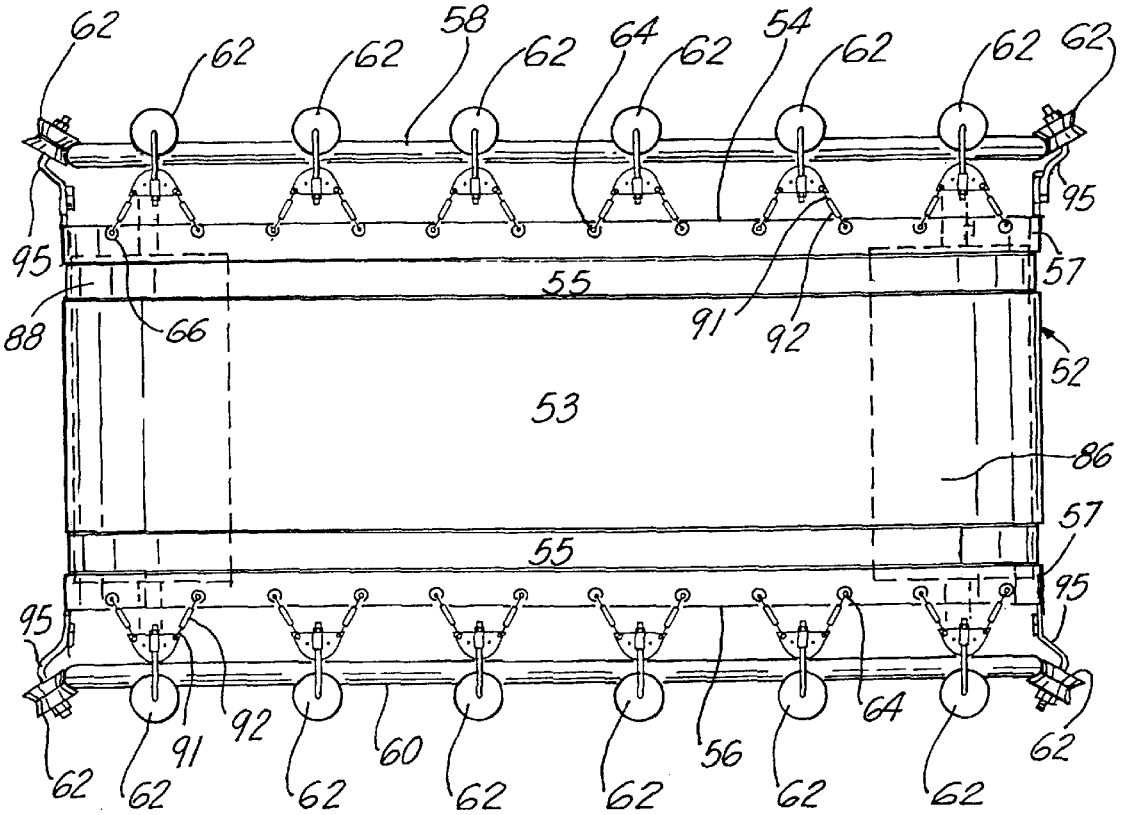
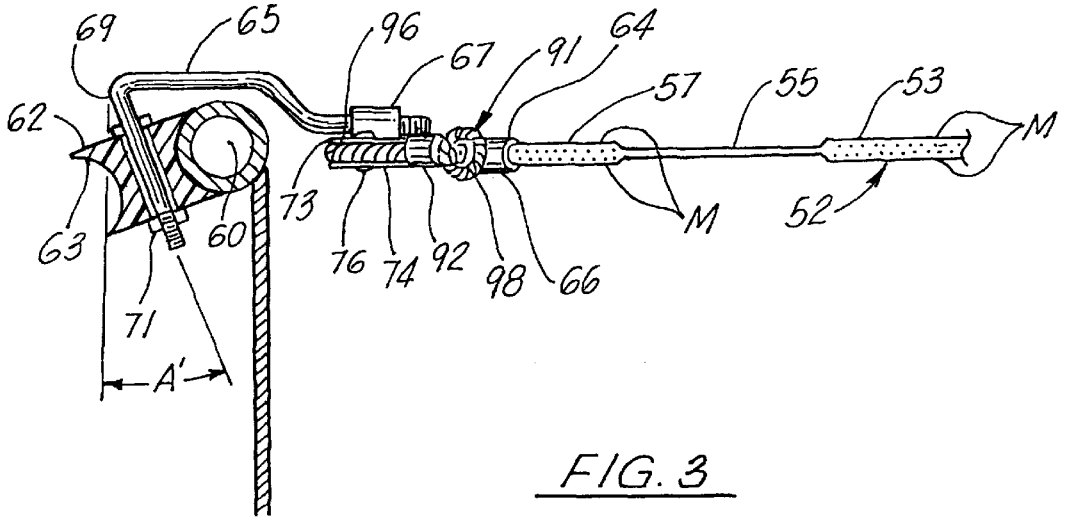
FIG. 3

SUSPENSION SYSTEM FOR TREADMILL WITH TRAMPOLINE-LIKE SURFACE

CROSS-REFERENCE TO RELATED APPLICATIONS

Not applicable.

STATEMENT REGARDING FEDERALLY SPONSORED RESEARCH

Not applicable.

BACKGROUND OF THE INVENTION

1. Field of the Invention

This invention relates to treadmills with trampoline-like surfaces and, more particularly, to an improved suspension system for connecting the movable mat or belt between supporting rails adjacent to the edges of the belt in such an apparatus.

Treadmills utilize an endless moving belt that allows an individual to walk, jog or run in place. Treadmills are useful not only for exercise, but for rehabilitation programs and medical testing such as the "stress test" which is commonly used. There is a demand for treadmills in indoor health clubs since many clubs are not able to build a running track and a treadmill provides the capability of a well-rounded exercise program.

Most treadmills are formed with a thin, endless belt that travels over a supporting surface so that the belt can withstand the weight of the individual using it. The rigid surface beneath the belt in these treadmills can cause shin splints or other stress-related injuries to the legs of the user. The use of treadmills of this design in rehabilitation programs is limited because of the impact on the legs of the users.

It has been found that a treadmill which utilizes a trampoline-like surface with a built-in resiliency reduces impact on the legs of the users to the point where such a machine can be used as a primary therapeutic aid for rehabilitation from leg injuries, because it significantly reduces the wear and tear on the legs of the user.

2. Description of the Related Art

U.S. Pat. No. 4,938,473 which issued on Jul. 3, 1990, describes such a treadmill with a trampoline-like surface. The suspension system of this treadmill is formed of transporter assemblies that included one or more springs spaced at an angle between each spring carrier and the belt to provide lateral support and stability for the belt. However, belts which utilize springs have a tendency to be unstable and the spring fatigue caused the belt to become slack, requiring periodic adjustment.

Further, springs proved to increase the expense of fabrication and maintenance to the machine due to spring failure and spring cuts.

An improvement over the treadmill with a trampoline-like surface described in U.S. Pat. No. 4,938,473, is described in U.S. Pat. No. 5,250,012, in which the springs located between the belt and rails were eliminated. The improvement included the use of a belt with built-in spring-like properties that was resilient along its width, but resisted stretching lengthwise.

A further improvement over the treadmills described above is described in U.S. Pat. No. 5,330,401 in which a suspension system utilizing a flexible wire cable as part of the transporter assembly for supporting the belt between the support rails was devised. This cable system reduced costs and at the same time allowed the proper tensioning in the belt to be achieved quickly and easily. However, the transporter assemblies used for connecting the flexible cables to the support rails were formed of a relatively large number of moving parts and restricted the high-end speed of the running surface, as well as making the fabrication difficult and expensive.

Therefore, there is a need for providing a transporter assembly for connecting the belt to the supporting rails formed of a simple design which would maximize the speed of the running surface and reduce fabrication time and expense.

SUMMARY OF THE INVENTION

The problems discussed above have been solved by providing an improved suspension system for the endless belt that forms the running surface of a treadmill with a trampoline-like surface. In accordance with the invention, the suspension system is made up of a series of transporter assemblies for connecting the support rails and belt along each edge of the belt. Each transporter assembly has at least one roller adapted to engage and move along the support rail. A bracket assembly is connected between each roller and lateral edge of the endless belt. In order to provide stability and allow for an increased high-end speed for the endless belt, the bracket is oriented to maintain the axis of rotation of each roller at an angle between about 10–25 degrees toward the running surface relative to a plane perpendicular to the running surface. Preferably, the angle is about 15 degrees.

The roller is preferably formed of a self lubricating material such as ultra-high molecular weight ("UHMW") polyethylene. Other types of self-lubricating and even non-self-lubricating materials can also be used. The roller is preferably formed with a V-shaped notch with sidewalls oriented at about 45 degrees and a rounded apex for engaging the support rails. The relatively deep V-shaped notch provides for greater stability and tracks better than previously used rollers with a shallow notch.

The bracket preferably includes a hardened steel bolt that extends between the roller and non-stretch cables connected to grommets formed along the lateral edges of the belt. One end of the belt is connected through a nut to a carrier for engaging the cable, while the other end has a neck portion that is bent for insertion into bearings for the roller. This neck portion is bent to achieve the 10–25 degree angle discussed above.

The rails can be slightly flared at each end or, alternatively, each end can be lengthened a small amount in order to maintain tension in the belt as the rollers move around the ends of the rails.

BRIEF DESCRIPTION OF THE DRAWINGS

In order obtain a better understanding of the invention, reference may be had to the preferred embodiment set forth below, taken in conjunction with the accompanying drawings in which:

FIG. 2 is a plan view of the endless belt and carrier rails for the treadmill of FIG. 1, which the protective covers removed to show details of the suspension system;

FIG. 3 is a partial sectional view of one of the connectors for connecting one edge of the endless belt to one of the carrier rails;

DETAILED DESCRIPTION OF INVENTION

The foregoing disclosure and description of the invention are illustrative and explanatory thereof, and various changes in the details of the illustrated apparatus and construction and method of operation may be made without departing from the spirit of the invention.

Figure 1:
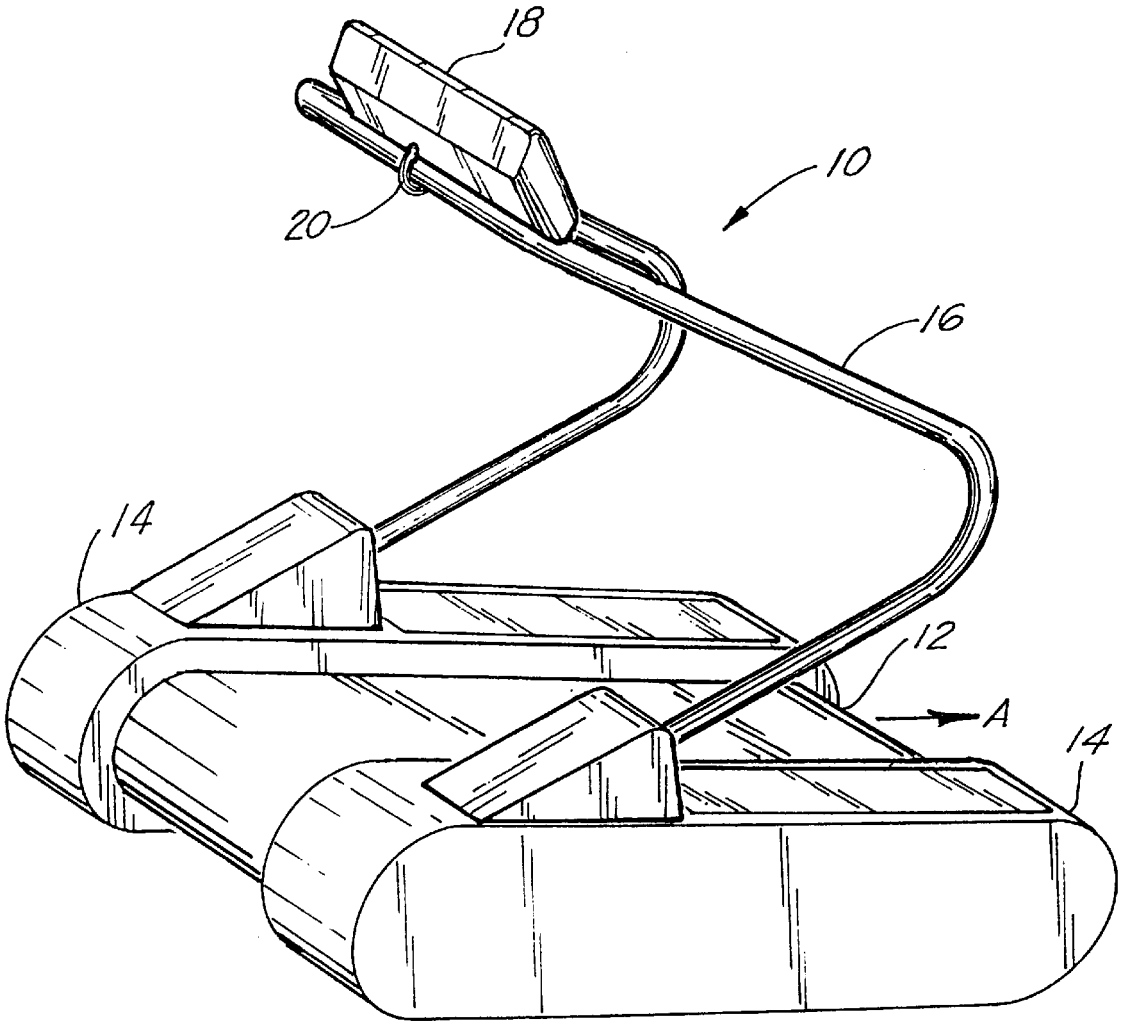
FIG. 1 is a perspective view of a treadmill with a trampoline-like surface of the type in which the present invention may be utilized.

FIG. 1 shows generally a treadmill with a trampoline-like surface of the present invention designated generally be reference numeral 10. In FIG. 1, the treadmill apparatus has an endless belt 12 that is supported as described in greater detail below so that a runner, jogger or walker can stand upon the belt surface. As the belt 12 moves in the direction shown by arrow 14, the runner, walker or jogger can move his or herself through a typical jogging, walking, running gait yet remain in the same position as is typical with all treadmills. However, with the treadmill of the type described, a cushioned trampoline-like surface is provided because the belt 12 is formed to be inherently resilient as described in U.S. Pat. No. 5,250,012, which allows the belt to expand laterally, but maintain essentially the same length longitudinally. Alternatively, the peripheral edge portions of the belt can be supported by plurality of spring assemblies as described in U.S. Pat. No. 4,938,473. The inherently resilient belt is preferred for the reasons described in U.S. Pat. No. 5,250,012.

Although the details of the assembly are not shown in FIG. 1 as a result of the housing portions 14, they are described in greater detail below in conjunction with the other figures. The treadmill of FIG. 1 also has a handlebar 16 on which a display panel 18 is mounted. The handlebars are preferably formed of two sections connected at 20 for ease of assembly and shipping. The connection between the handlebar sections is preferably formed with electrical insulation in order to prevent the propagation of electromagnetic waves that can effect a heart monitor that is part of the control panel. The control panel can include the typical LED displays for speed, time, distance, calories burned and the like in order to provide a visual display for the user.

Figure 4:
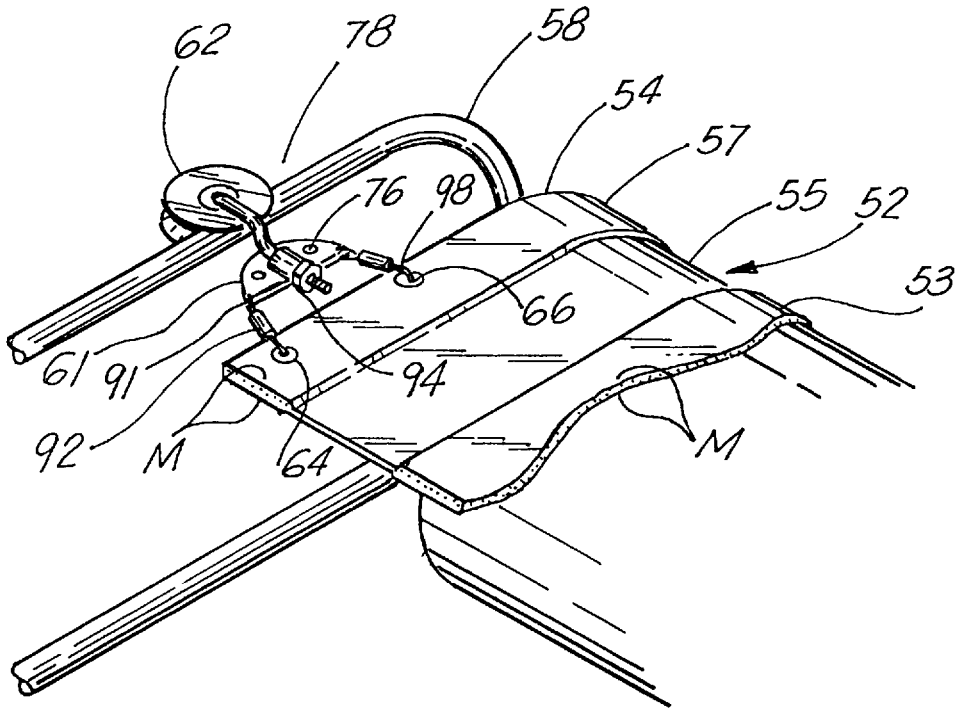
FIG. 4 is a perspective view of one of the connectors of FIG. 2.

FIGS. 2–4 illustrate a preferred embodiment of the suspension system of the present invention. In those figures, a belt 52 with lateral edges 54–56 is connected to support rails 58–60 by means of a plurality of transporter assemblies described in greater detail below. The belt 52 is formed with a center non-resilient section 53 bounded on both edges by resilient sections 55 which impart resiliency to the belt 52. An outer reinforced section 57 is located outside each resilient section 55 so that the lateral edges 54, 56 of the belt 52 can be connected to the connectors as described below.

Grommets 64 are incorporated in openings 66 formed along the reinforced outer section 57 of the belt 52. As best shown in FIG. 4, the connectors are connected to the reinforced outer sections 57 of the belt 52 by the length of flexible wire cable 91 as described in greater detail in U.S. Pat, No. 5,330,401, that is threaded through both a carrier 61 and a grommet 64 in the opening 66 and secured by a crimp 92. As shown in FIG. 2, a plurality of transporter assemblies are connected to each edge of the belt 52.

Each carrier is formed of two sections 73, 74 which are connected to each other through a pair of rivets 76 (FIG. 3), or other means. As also described in U.S. Pat. No. 5,330,401, the carriers 61 are in the form of a wire cable thimble with parallel openings through which the cable 91 is threaded. In the installation of the wire cable suspension system, one end of the flexible wire cable 91 is threaded through a grommet 64 in the opening 66 on the outer edge 57 of the belt 52. A tight loop 98 in the cable 91 is formed by a swage 92 that is crimped around the looped cable sections. The tight loop 98 compresses the edge 54 of the belt 52 restricting movement of the cable 91 and the grommet 64.

The cable 91 is then passed through a sheath 96 of nylon or other suitable protective cladding in the carrier 61. The sheath 96 prevents any metal- to-metal contact between the wire cable 91 and the carrier 62. The loose end of the cable 91 is then threaded through the next adjacent grommet 64 in the belt 52. The cable 91 is pulled to apply tension to the belt 52 and a tight loop 98 is formed by a crimping swage 92. The excess cable 91 is trimmed and the next carrier 61 is installed in the same manner.

In accordance with the invention, the carriers 61 are connected to the rails 58, 60 through rollers 62. The rollers 62 are formed of a self-lubricating material such as UHMW polyethylene. Using rollers with this material is an advantage over ones used previously formed of Delrin as the UHMW polyethylene is slightly softer and has better self-lubricating qualities.

The rollers are preferably formed with what is called a deep-V or a throat 63 formed at about a 45 degree angle relative to the sides. This shape provides a larger contact area which results in better tracking as the belt 12 is moving. The carriers 61 are connected to the rollers 62 through a specially-designed roller bracket bolt 65. The bolt is connected at one end to the carrier 61 through a holder 67 formed as part of the carrier 61 (FIG. 3.), and to the roller through an arm 69 formed as part of the bolt 65. A' bolt 71 holds the arm 69 in the bearing for the roller 62.

The roller bracket bolt 65 is formed as shown in FIG. 3 such that the rollers 62 are oriented to maintain the axis of rotation of each roller 62 at an angle A' of between 10–25 degrees, preferably 15 degrees, toward the running surface relative to a plane perpendicular to the running surface 53. This angle has been found to provide greater stability for the running surface 53 and allow it to maintain its tracking through a full range of speeds. The outer ends of the support rails 58, 60 can be slightly flared at about a 2–4 degree angle (not shown) in order to provide better tracking at the ends of the support rails, but this is not deemed essential as the ends of the rails can be extended a short distance to achieve the same result. In this way, tension is maintained on the belt as the rollers 62 move around the ends of the support rails, without stretching the belt.

The angle A' as discussed above allow the belt to move at a higher rate of speed while it is maintained at a substantially uniform tension across the length during those different rates of speed.

As discussed in the other patents described above, the treadmill is moved between a pair of drums 86, 88 (FIG. 2) located at both ends of the running surface 53. The drums are mounted in a known way on a suitable bearing support and can either be allowed to move through the force exerted by a person moving on the belt, or both of them can be connected to a motor for automated movement. In order to increase the efficiency of the machine, a flywheel can either be built into or connected to one or both of the drums 86, 88.

The use of the roller bracket bolt 65 allows the machine to be more readily assembled as only one adjustment needs to be made in order to provide proper tensioning. This can be done by tightening the nut 71 after the bolt is inserted through the holder 67.

With the brackets described in U.S. Pat. No. 5,330,401, assembly was a time-consuming operation because each of the connecting brackets had to be connected to the cable holders before the cables could be tensioned. By using the roller bracket bolt 65, each of the cable sections can be connected and the belt properly tensioned by simply adjusting the nut 71 on each of the roller brackets bolt 65.

By utilizing the improved suspension system described above, the advantages described above, the advantages discussed are imparted to a treadmill using a trampoline-like surface. It should be understood that other improvements and modifications can be made to the invention without departing from the scope of the invention as set forth in the appending claims.

What is claimed is:

1. A treadmill with a trampoline-like surface, comprising:

(a) an endless belt with generally parallel lateral edges and an upper surface forming a running surface;

(b) belt supports in close proximity to and extending along the lateral edges of the endless belt;

(c) a suspension system for suspending the endless belt from the supports as the belt moves in a longitudinal direction, the suspension system comprising a series of connectors along each lateral edge, each connector including at least one roller adapted to engage and move along the support, and a bracket connected between the roller and lateral edge of the endless belt;

(d) whereby each roller has an axis of rotation and the bracket is oriented to maintain the axis of rotation of each roller at an angle of between about 10–25 degrees toward the running surface relative to a plane perpendicular to the running surface.

2. The treadmill of claim 1, wherein the angle of the axis of rotation is about 15 degrees.

3. The treadmill of claim 1, wherein the bracket comprises a hardened steel bolt formed to orient said rollers at said angle.

* * * * *